US009944415B2

(12) United States Patent
Lin

(10) Patent No.: US 9,944,415 B2
(45) Date of Patent: Apr. 17, 2018

(54) FILLING CONTAINER

(71) Applicant: Hui Lin, Taizhou (CN)

(72) Inventor: Hui Lin, Taizhou (CN)

( * ) Notice: Subject to any disclaimer, the term of this patent is extended or adjusted under 35 U.S.C. 154(b) by 39 days.

(21) Appl. No.: 15/195,701

(22) Filed: Jun. 28, 2016

(65) Prior Publication Data

US 2017/0240304 A1 Aug. 24, 2017

(30) Foreign Application Priority Data

Feb. 20, 2016 (CN) ..... 2016 2 0131221 U
Feb. 20, 2016 (CN) ..... 2016 2 0131314 U
May 17, 2016 (CN) ..... 2016 2 0450162 U

(51) Int. Cl.
*B65B 3/04* (2006.01)
*A63H 27/10* (2006.01)

(52) U.S. Cl.
CPC ..... *B65B 3/04* (2013.01); *A63H 27/10* (2013.01)

(58) Field of Classification Search
CPC ..... B65B 3/04; B65B 39/007; B65B 7/025; B65B 3/17; A63H 27/10; A63H 2027/1033
USPC ..... 141/114; 24/281, 280, 282
See application file for complete search history.

(56) References Cited

U.S. PATENT DOCUMENTS 3,315,740 A * 4/1967 Withers ..... B01D 1/06 156/196
3,645,298 A * 2/1972 Roberts ..... A61M 39/28 138/40
4,630,847 A * 12/1986 Blenkush ..... F16L 37/56 285/242
4,932,689 A * 6/1990 Bradley ..... F16L 33/225 285/255
5,909,902 A * 6/1999 Seabra ..... F16L 37/0925 285/322
7,093,328 B2 * 8/2006 Geppert ..... F16L 33/04 24/280
9,682,789 B2 * 6/2017 Malone ..... A63H 27/10
9,776,744 B2 * 10/2017 Khubani ..... B65B 3/17
9,783,327 B2 * 10/2017 Khubani ..... B65B 3/17
(Continued)

FOREIGN PATENT DOCUMENTS

CN 104436683 A * 3/2015
CN 204193466 U * 3/2015
(Continued)

*Primary Examiner* — Jason K Niesz
*Assistant Examiner* — James Hakomaki
(74) *Attorney, Agent, or Firm* — Locke Lord LLP; Tim Tingkang Xia, Esq.

(57) ABSTRACT

The present invention relates to a filling container including a joint, where a side of the joint is provided with an inlet, another side of the joint is provided with a tube insertion cavity, and an inner end of the tube insertion cavity is connected to the inlet; a hollow tube bundle, including several hollow tubes, where an upper part of the hollow tube bundle is entirely inserted into the tube insertion cavity; a container, mounted at a lower end portion of a hollow tube by using an elastic fastener, where an inner cavity of the container is in communication with an inner passage of the hollow tube; and a holding mechanism, mounted on the joint at the tube insertion cavity, where the holding mechanism enables the tube insertion cavity to contract and hold the hollow tube bundle.

9 Claims, 20 Drawing Sheets

(56) References Cited

U.S. PATENT DOCUMENTS

| | | | | |
|---|---|---|---|---|
| 2002/0163989 | A1* | 11/2002 | Dallongeville | G21C 19/07 376/272 |
| 2003/0124734 | A1* | 7/2003 | Dannoux | B01J 4/001 436/180 |
| 2003/0193190 | A1* | 10/2003 | Werth | F16L 33/225 285/243 |
| 2006/0272432 | A1* | 12/2006 | Belongia | G01N 1/10 73/864.63 |
| 2010/0024910 | A1* | 2/2010 | Nakamori | B65B 39/00 138/39 |
| 2010/0326212 | A1* | 12/2010 | Furey | G01N 1/10 73/863.31 |
| 2011/0042938 | A1* | 2/2011 | Gallagher | F16L 9/147 285/148.13 |
| 2013/0319575 | A1* | 12/2013 | Mendyk | A61J 1/1475 141/1 |
| 2015/0259085 | A1* | 9/2015 | Malone | A61J 1/10 141/246 |
| 2017/0043270 | A1* | 2/2017 | Harter | A63H 27/10 |
| 2017/0225809 | A1* | 8/2017 | Kamhi | B65B 3/17 |

FOREIGN PATENT DOCUMENTS

| | | | | | |
|---|---|---|---|---|---|
| CN | 204250477 | U | * | 4/2015 | |
| CN | 204293867 | U | * | 4/2015 | |
| CN | 104986364 | A | * | 10/2015 | |
| CN | 204829063 | U | * | 12/2015 | |
| CN | 205198964 | U | * | 5/2016 | |
| GB | 2216614 | A | * | 10/1989 | F16L 33/08 |
| GB | 2255385 | A | * | 11/1992 | E04C 5/12 |

* cited by examiner

FILLING CONTAINER

CROSS-REFERENCE TO RELATED PATENT APPLICATIONS

This application claims priority to and the benefit of Chinese Patent Application Nos. CN201620131314.X, CN201620131221.7, both filed Feb. 20, 2016, and CN201620450162.X, filed May 17, 2016 in the State Intellectual Property Office of P.R. China, which are incorporated herein in their entireties by reference.

FIELD OF THE INVENTION

The present invention relates to the field of filling devices, and in particular, to a novel filling container.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

It is well known that a water fight is an entertainment activity that is very popular and is welcome by children abroad, so a greater number of water balloons are demanded. Because carrying out a water fight by using water balloons is full of fun, has low costs, and may involve a lot of people to entertain them all, carrying out a water fight by using water balloons is gradually popular at home. However, a conventional manner of making water balloons is excessively slow, water balloons are made one by one, which is time-consuming and laborious. U.S. Pat. No. 9,051,066 discloses a system and method for filling containers with fluids, including an opening at an end and a housing formed with a plurality of through holes at another end, where upper ends of a plurality of hollow tubes are respectively connected to the plurality of through holes in a one-to-one correspondence manner, a lower end of the hollow tube is detachably connected to a container, and the container is connected to the hollow tube by using an elastic fastener. Although multiple water balloons can be made at one time by using such a structure, this structure is a single-use product and cannot be used repeatedly.

Therefore, a heretofore unaddressed need exists in the art to address the aforementioned deficiencies and inadequacies.

SUMMARY

One of the objectives of the present invention is to provide a novel filling container that has a simple structure, can be conveniently used, can simultaneously produce multiple water balloons or balloons or fill the balloons with another liquid, has high efficiency and tightness, and can be repeatedly used.

In one aspect of the present invention, the filling container includes:

a joint, where a side of the joint is provided with an inlet, another side of the joint is provided with a tube insertion cavity, and an inner end of the tube insertion cavity is connected to the inlet;

a hollow tube bundle, including several hollow tubes, where an upper part of the hollow tube bundle is entirely inserted into the tube insertion cavity;

a container, mounted at a lower end portion of a hollow tube by using an elastic fastener, where an inner cavity of the container is in communication with an inner passage of the hollow tube; and a holding mechanism, mounted on the joint at the tube insertion cavity, where the holding mechanism enables the tube insertion cavity to contract and hold the hollow tube bundle.

In one embodiment, a lower part of the joint is connected to a rubber sleeve, a lower-end open mouth of the rubber sleeve forms the tube insertion cavity, and the upper part of the hollow tube bundle is inserted into the rubber sleeve; and the holding mechanism includes a banding apparatus surrounding a peripheral portion of the rubber sleeve, and the banding apparatus contracts, bands the rubber sleeve, and enables the rubber sleeve to hold the hollow tube bundle.

In one embodiment, a side of the joint extends outward to form a clamping groove; and the holding mechanism is a compression block, the compression block is detachably mounted inside the clamping groove, and the clamping groove cooperates with the compression block to enclose the tube insertion cavity.

In one embodiment, a fixed block is formed on two sides of the compression block, a slide groove matching the fixed block is formed on a side wall of the clamping groove, and the fixed block is fixedly connected to the slide groove by using a fastener.

In one embodiment, a compression surface of the compression block is a plane; and the compression surface cooperates with an inner side wall of the clamping groove to form a square bayonet.

In one embodiment, the hollow tube bundle includes several hollow tube layers, and a first seal soft cushion is disposed between two adjacent hollow tube layers.

In one embodiment, a second first seal soft cushions disposed between the hollow tube bundle and a side wall of a bayonet.

In one embodiment, a clamping sleeve is mounted on a side of the joint, several holding plates are formed on the clamping sleeve, and the several holding plates enclose the tube insertion cavity; and an inner wall of the joint protrudes inward to form a slope, and when the clamping sleeve extends into the joint and is fastened, a slope surface of the slope abuts against the holding plates, and the holding plates incline inward and hold the hollow tube bundle.

In one embodiment, an inner wall of the holding plate is provided with a third seal soft cushion.

In one embodiment, the joint is spirally connected to the clamping sleeve; and an outer wall of the holding plate or an upper end of the clamping sleeve is provided with an outer screw thread, and the slope surface of the slope or a lower end of the joint is provided with a matching inner screw thread.

In one embodiment, the hollow tube bundle is formed by combining several hollow tubes having an orthohexagnal cross section, so as to form a hollow tube bundle having a honeycomb-shaped cross section; or the hollow tube bundle is formed by combining several hollow tubes having a circular cross section.

In one embodiment, a filtering block is disposed inside a passage that connects the inlet and the tube insertion cavity inside the joint, several through holes running from top to bottom are formed on the filtering block, and the filtering block is disposed above the clamping sleeve.

In one embodiment, a step is formed on an inner wall of the passage that connects the inlet and the tube insertion cavity inside the joint, an upper end of the filtering block abuts against the step, and a lower end of the filtering block abuts against an upper end of the hollow tube bundle.

As compared with the prior art, the present invention has the prominent and advantageous technical effects:

1. The product designed in the present invention can simultaneously fill multiple balloons or containers with water or a liquid, so as to rapidly produce multiple liquid-filled balloons or balloons and overcome the disadvantages that conventionally making liquid-filled balloons or balloons one by one is time-consuming and laborious and has low efficiency, and after the liquid-filled balloons or balloons are filled up at one time, the product can be repeatedly used by replacing hollow tubes with new hollow tubes that have been provided with containers and placing the hollow tubes into the product.

2. In the present invention, the design of a rubber sleeve and a banding apparatus enables a hollow tube bundle to be mounted more conveniently merely by releasing the banding apparatus, placing the hollow tube bundle into the product, and then tightening up the banding apparatus to enable the rubber sleeve to hold the hollow tube bundle; and in addition, such a manner may be used repeatedly, and after the containers are filled up, the present invention can be used again only by replacing the hollow tubes with a group of hollow tubes that have been provided with containers, which is convenient and fast, saves costs, and is more environmentally friendly.

3. In the present invention, the design of a compression block enables the hollow tube bundle to be mounted more conveniently merely by releasing a fastener to remove the compression block, placing the hollow tube bundle into the product, then placing the compression block into the product and compressing the hollow tube bundle, and then fastening the compression block by using the fastener, and in addition, such a manner may be used repeatedly.

4. In the present invention, the design of a fixed block and a slide groove enables the compression block to be mounted more conveniently and more stably.

5. In the present invention, the design of a seal soft cushion enables to the apparatus to have better tightness and a better pressure keeping property and reduces loss of a liquid or gas.

6. In the present invention, the design of a clamping sleeve and the clamping sleeve provided with holding plates enables the hollow tube bundle to be mounted more conveniently merely by moving the holding plates of the clamping sleeve outward to a position where no deformation occurs, then placing the hollow tube bundle into the product, and then, further extending and screwing the clamping sleeve into a housing to deform the holding plates to hold the hollow tube bundle; and in addition, such a manner may be used repeatedly.

7. In the present invention, a cross section of a hollow tube is a regular hexagon or a circle, and an effect of a hollow tube having an orthohexagnal cross section is the most optimal; and a combination of hollow tubes having an orthohexagnal cross section enables to the several hollow tubes to attach to each other tightly, thereby enhancing tightness.

8. The present invention, the design of a filtering block enables all the containers to have similar liquid or gas filling speeds, so that water is fed in a more balanced manner, thereby improving production efficiency, can remove some impurities, and may also abut against the hollow tubes to enable the hollow tubes to be mounted more smoothly.

9. In the present invention, a step is designed to abut against the filtering block to enable the filtering block to be mounted more stably.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

Figure 1:
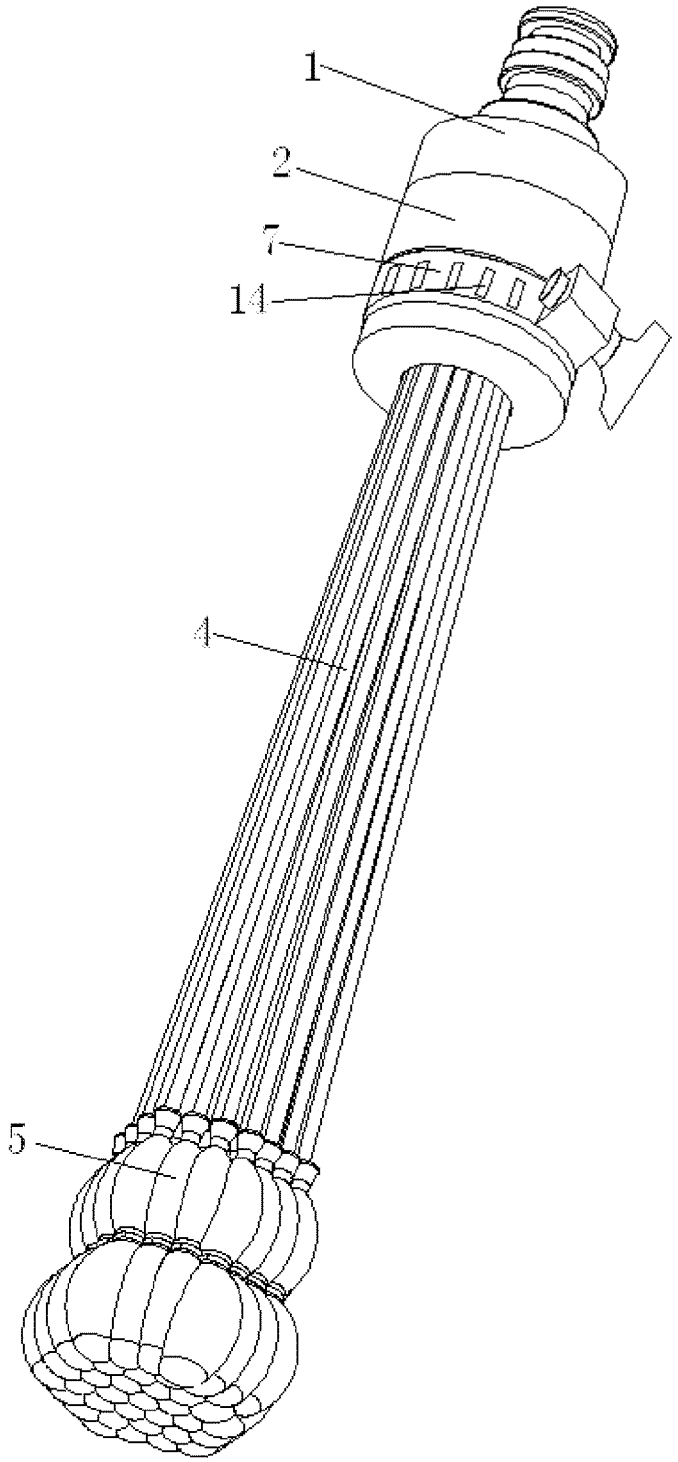
FIG. 1 is a schematic structural diagram of Embodiment 1 of a filling container according to the present invention.
Figure 2:
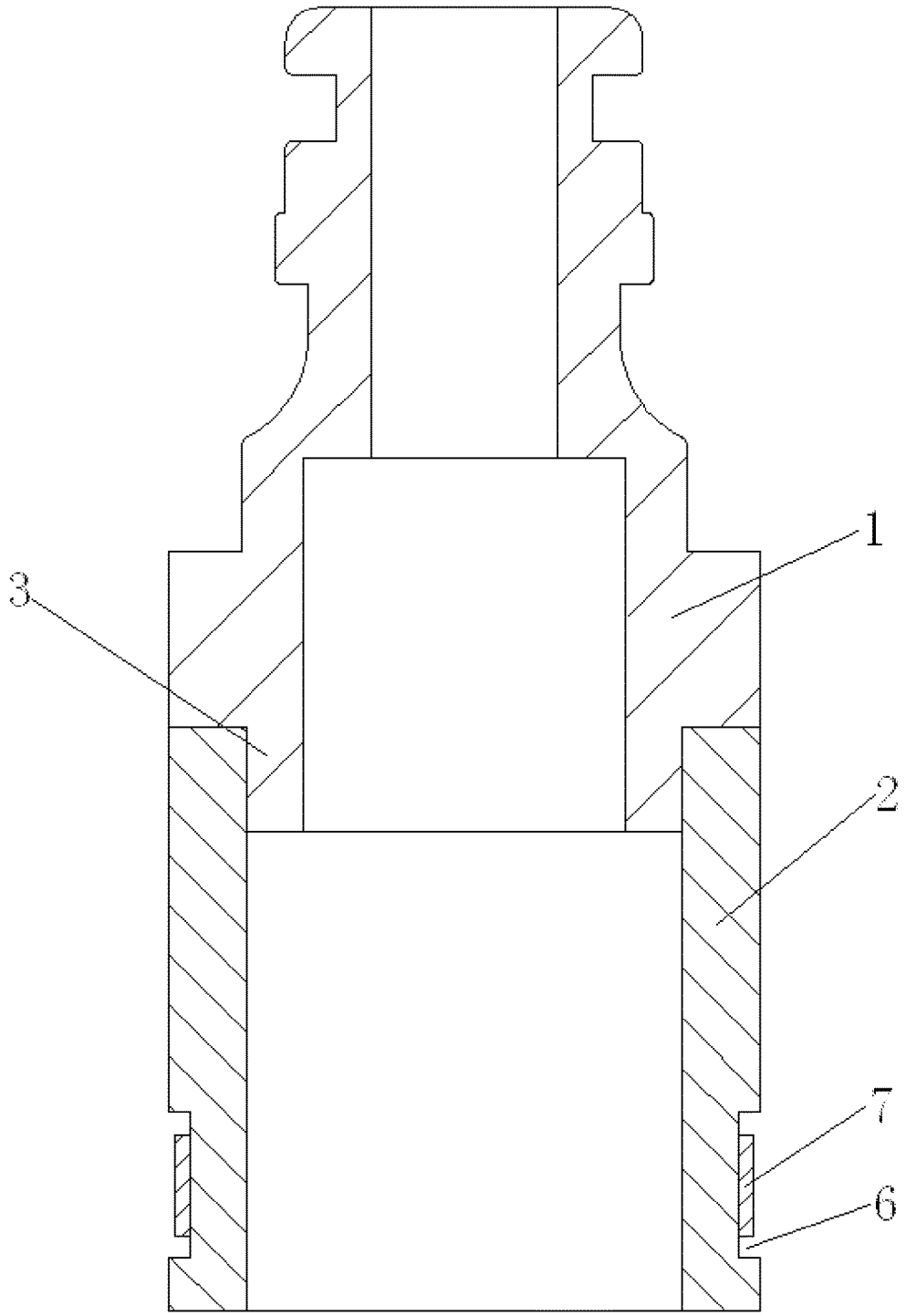
FIG. 2 is an internal structural diagram of Embodiment 1 of the filling container according to the present invention.
Figure 3:
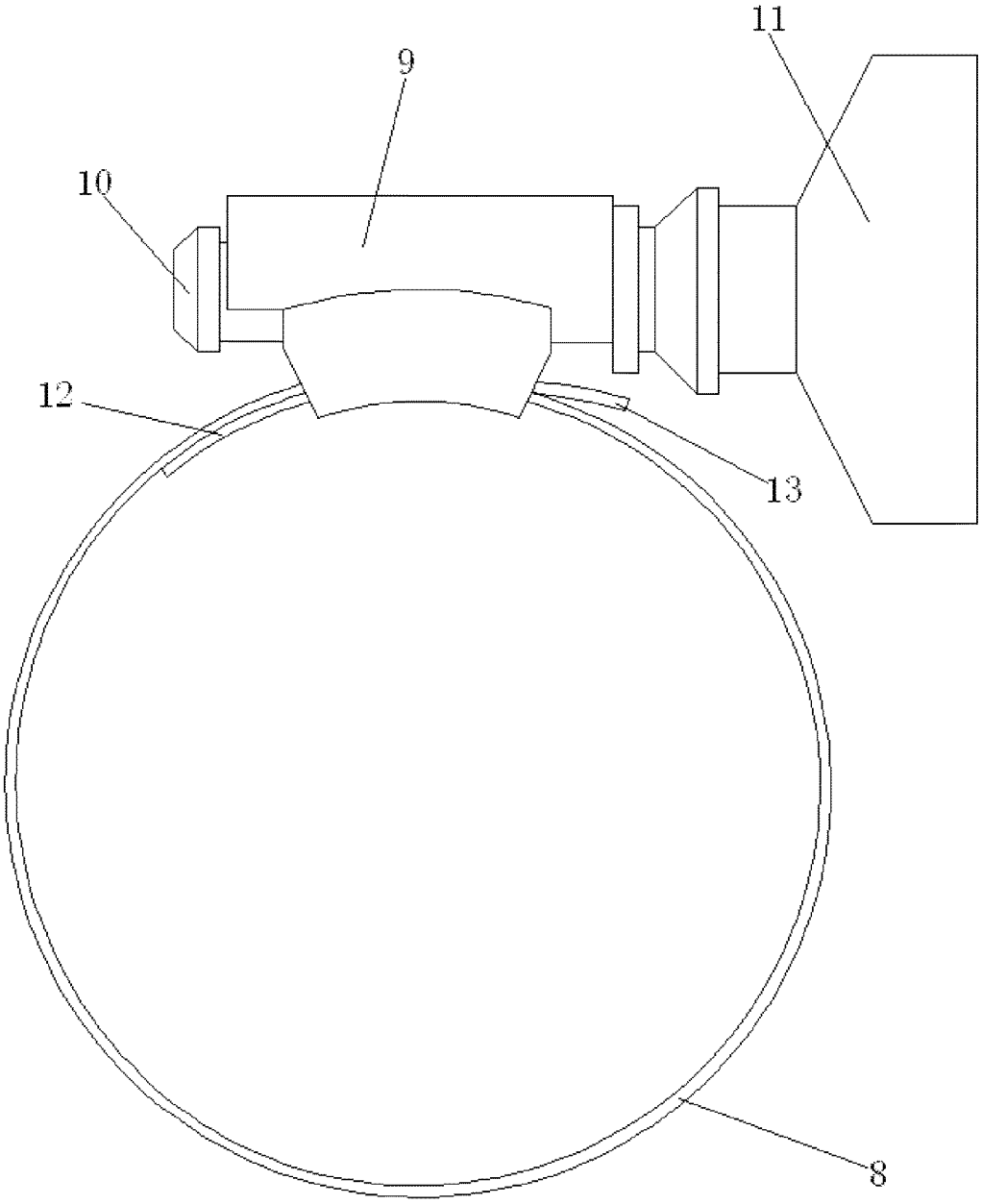
FIG. 3 is a schematic structural diagram of a hose clamp of Embodiment 1 according to the present invention.
Figure 4:
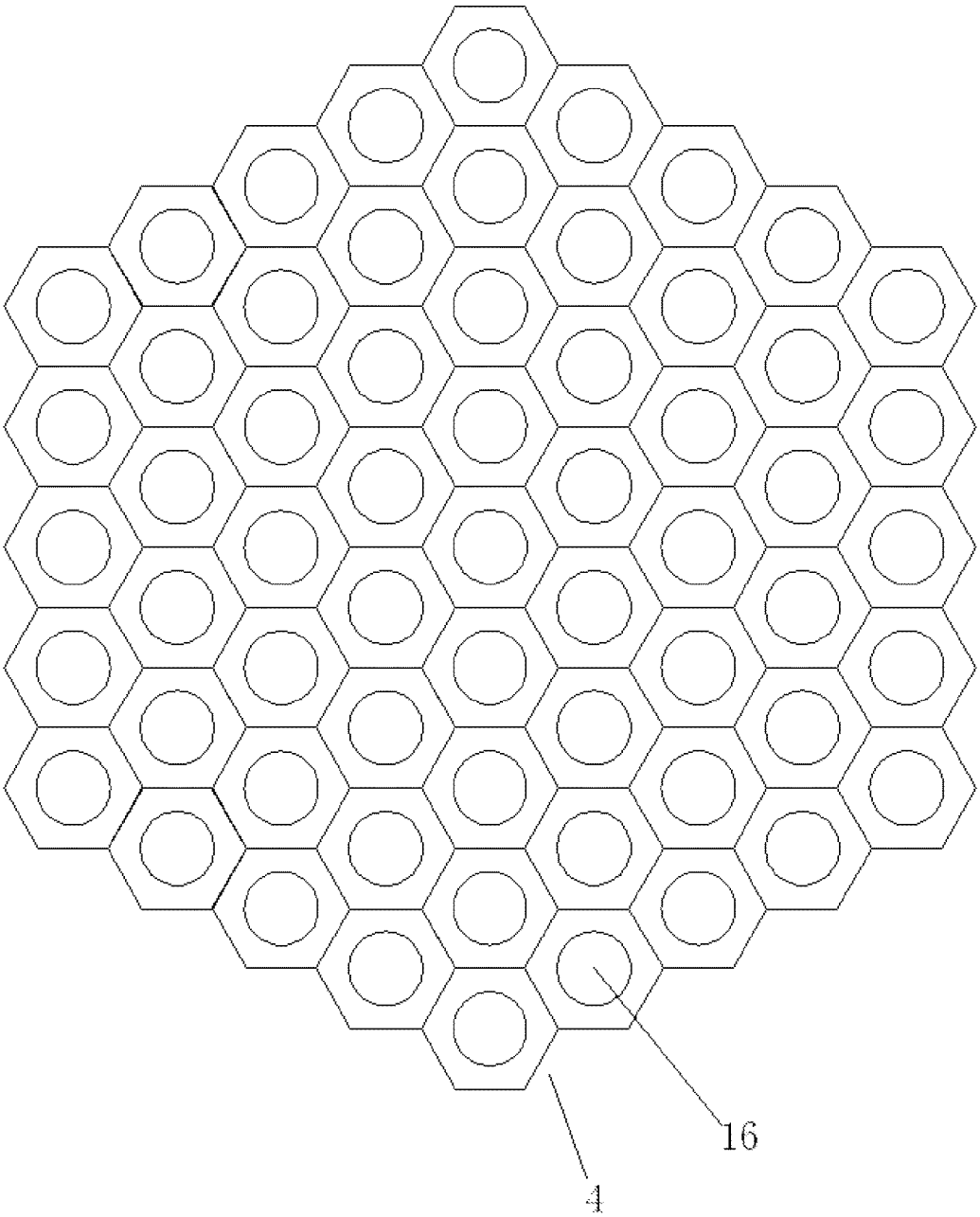
FIG. 4 is a schematic combination diagram of a hollow tube bundle of Embodiment 1 according to the present invention.
Figure 5:
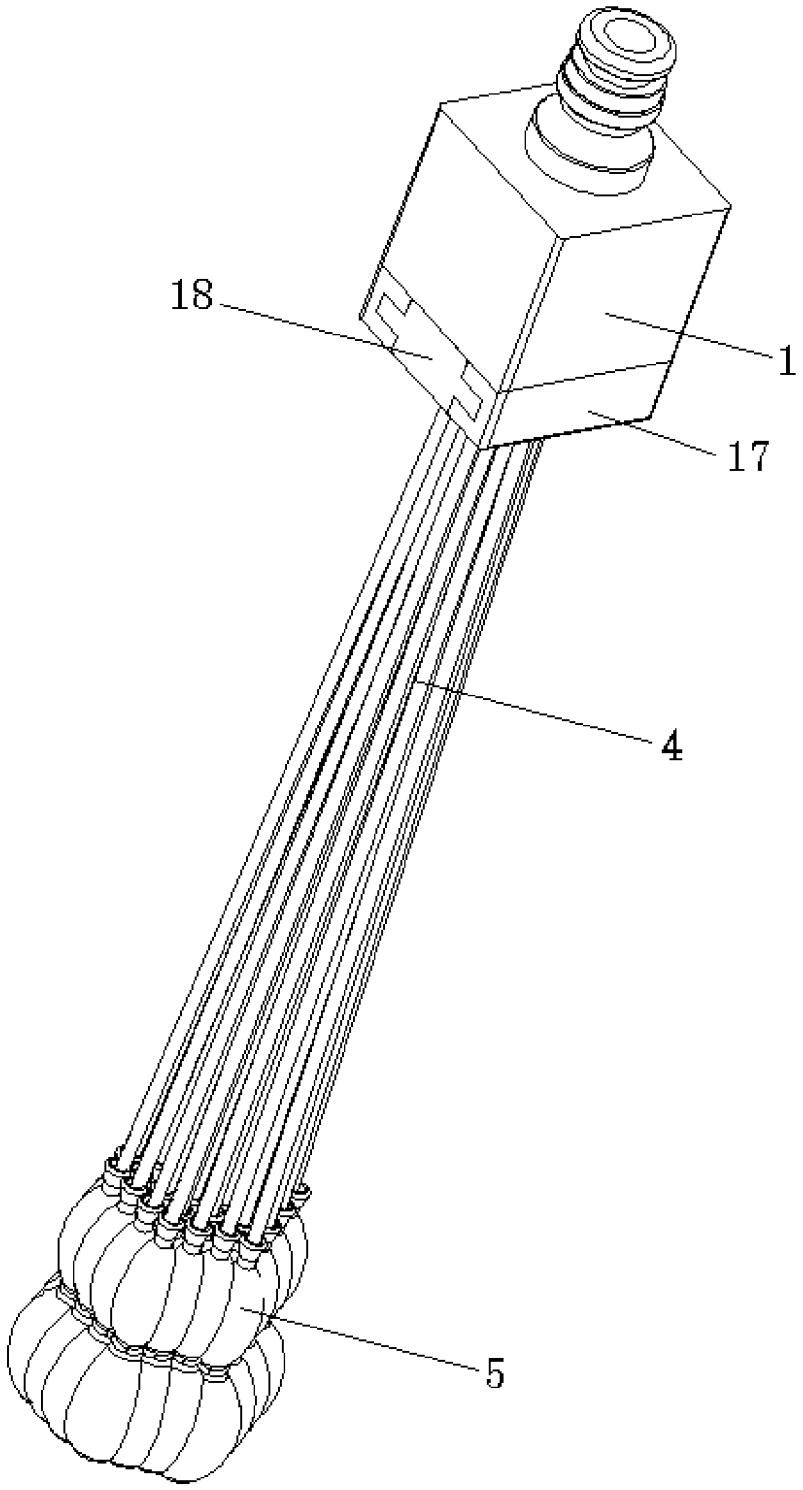
FIG. 5 is a first schematic structural diagram of Embodiment 2 of a filling container according to the present invention.
Figure 6:
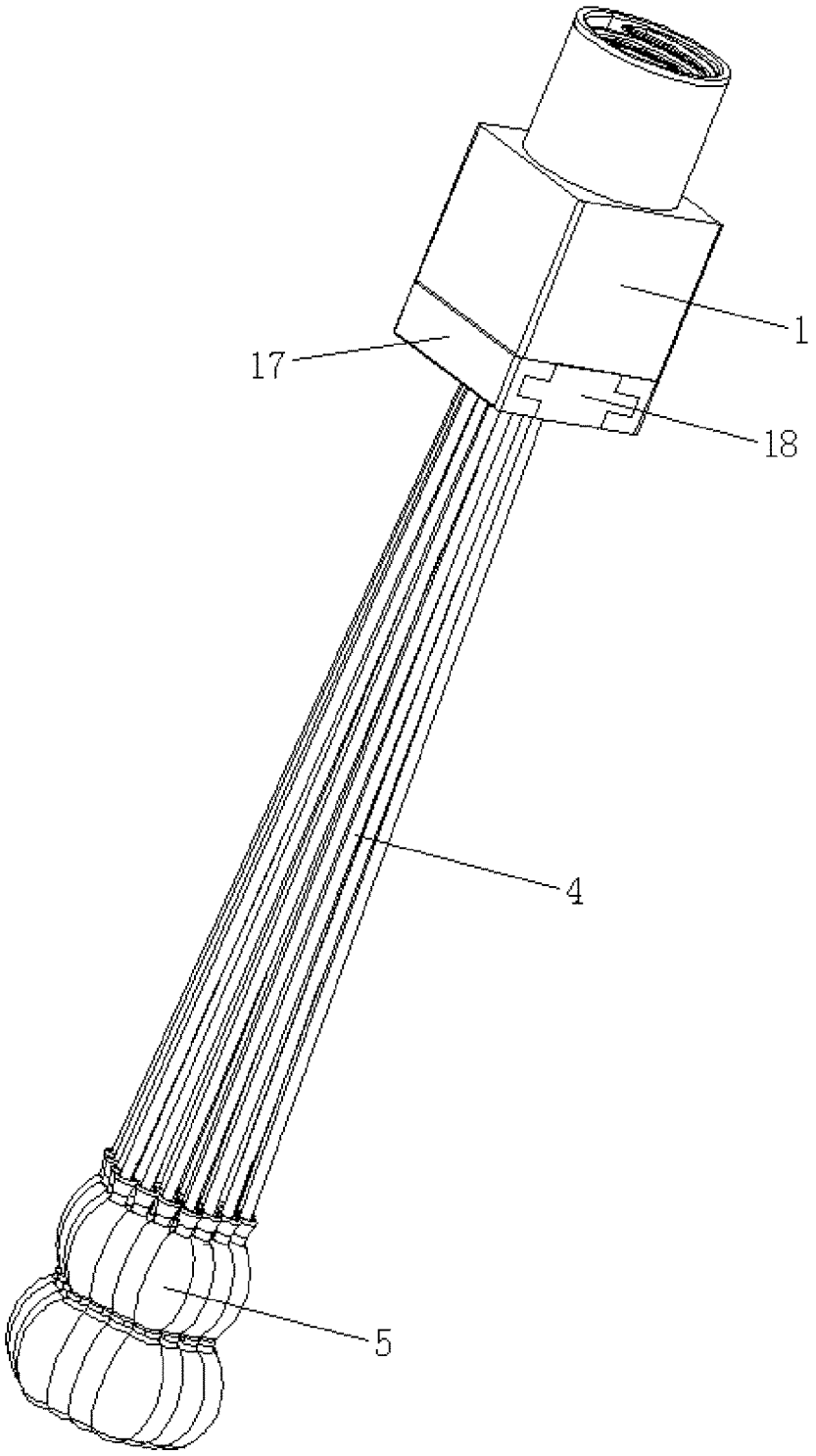
FIG. 6 is a second schematic structural diagram of Embodiment 2 of the filling container according to the present invention.
Figure 7:
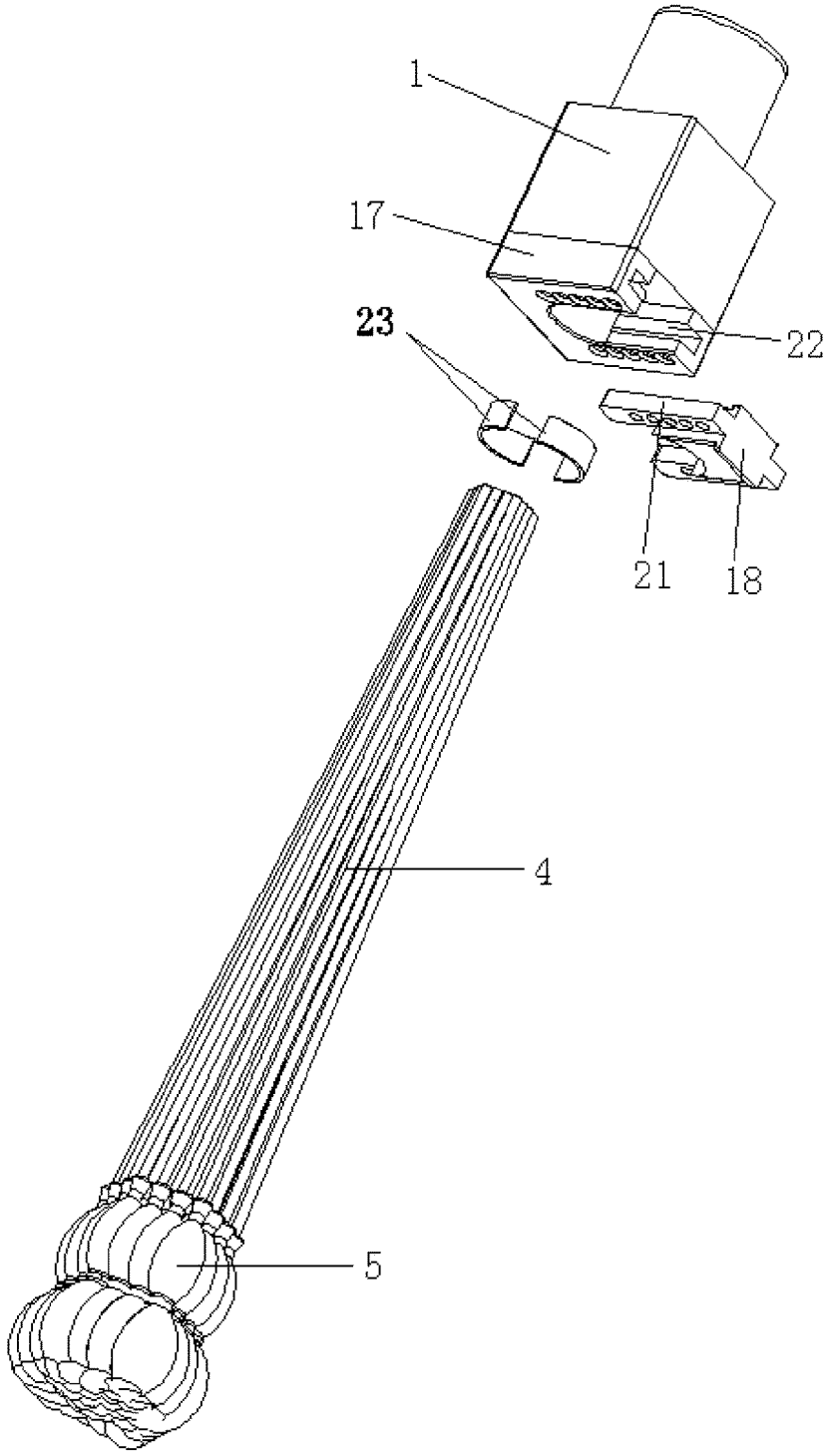
FIG. 7 is a component breakdown diagram of Embodiment 2 of the filling container according to the present invention.
Figure 8:
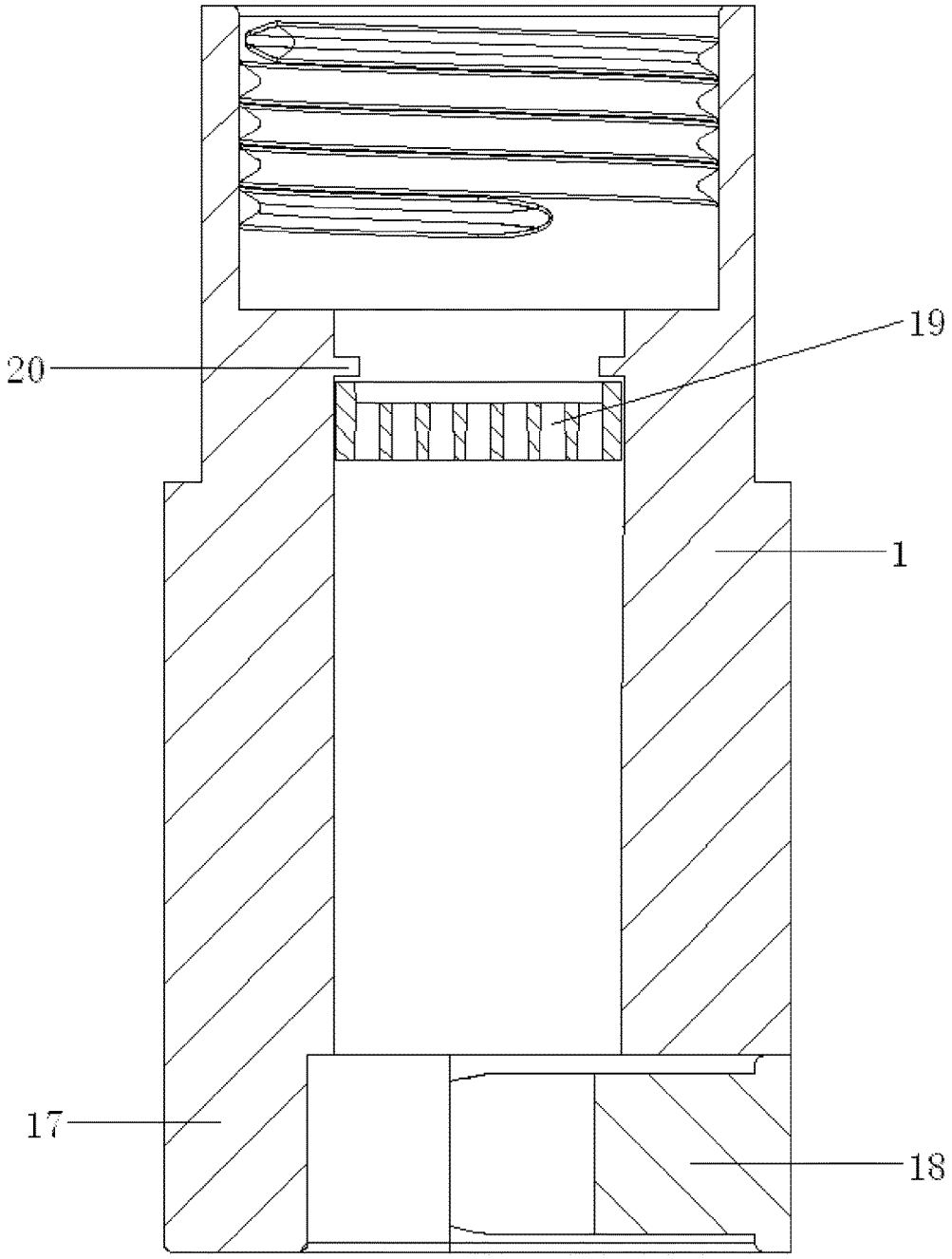
FIG. 8 is a schematic diagram of cooperation among a joint, a clamping groove, a filtering block, and a compression block of Embodiment 2 according to the present invention.
Figure 9:
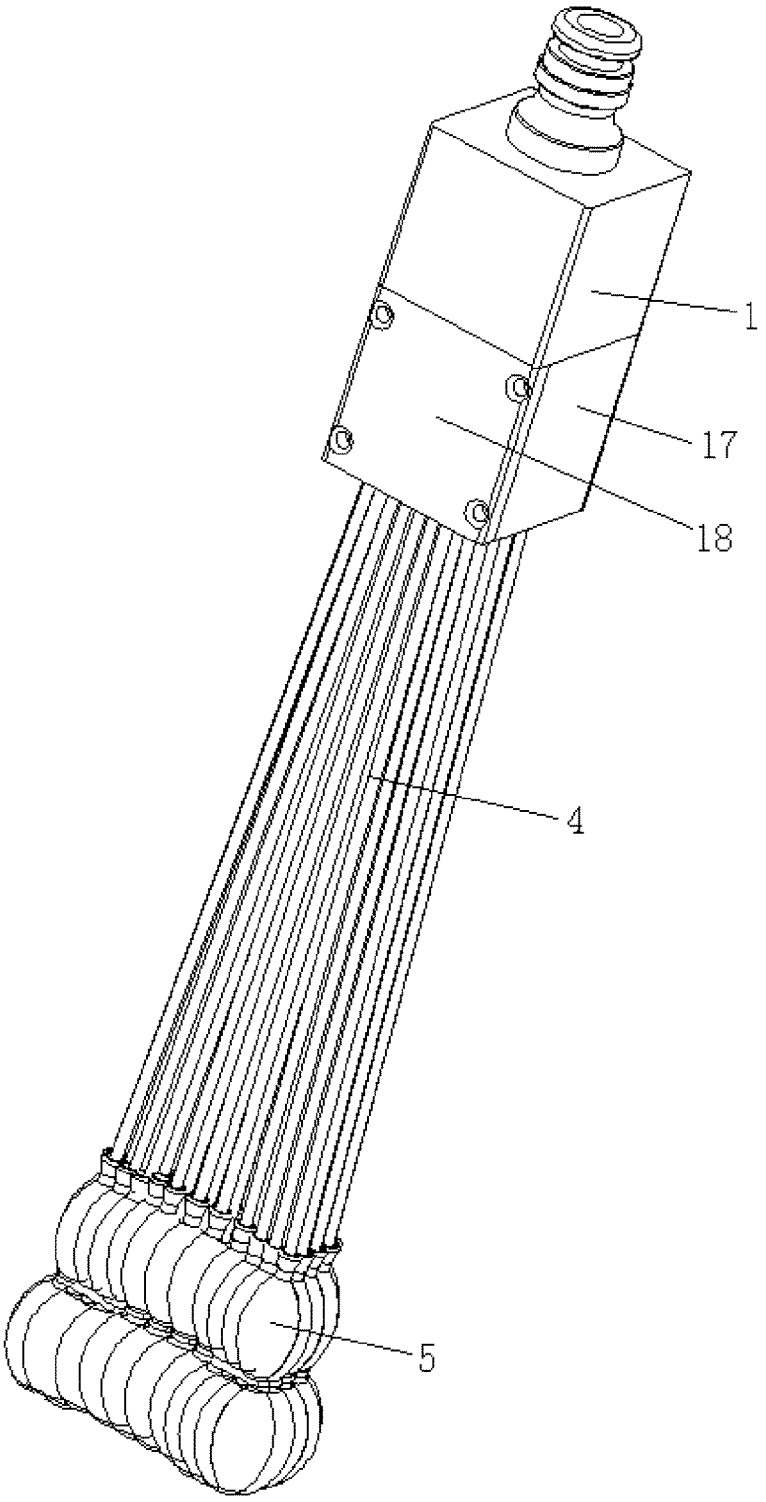
FIG. 9 is a first schematic structural diagram of Embodiment 3 of a filling container according to the present invention.
Figure 10:
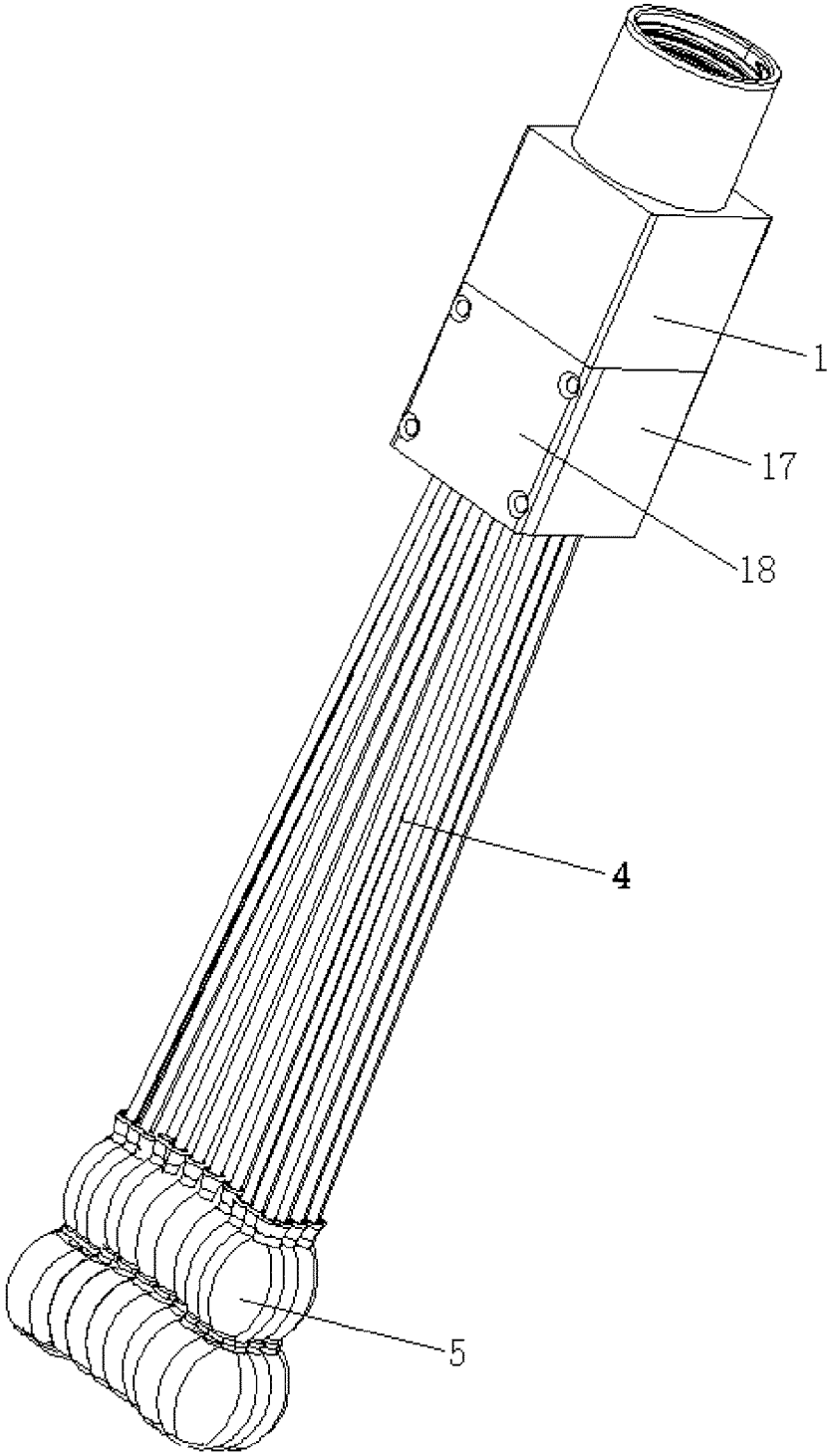
FIG. 10 is a second schematic structural diagram of Embodiment 3 of the filling container according to the present invention.
Figure 11:
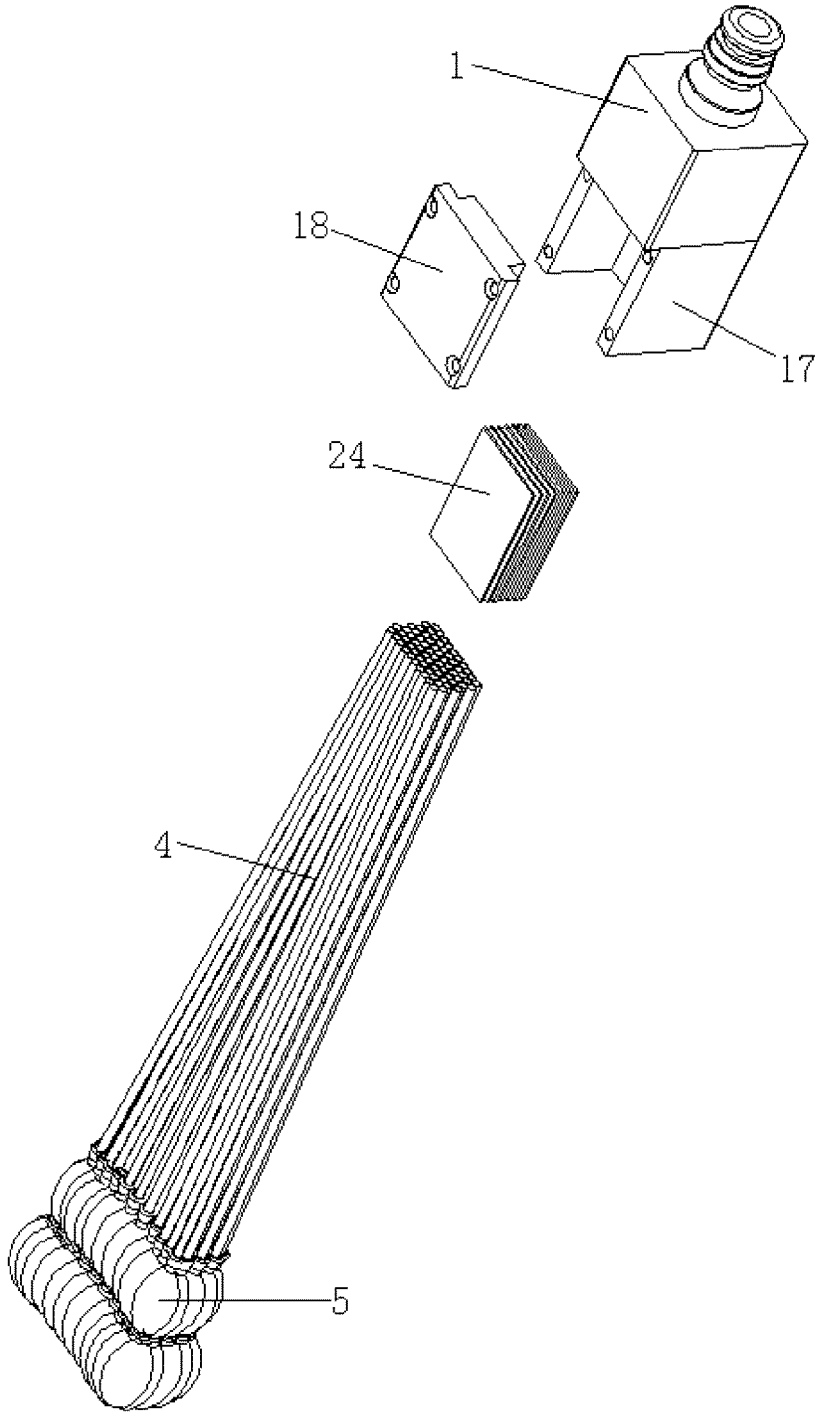
FIG. 11 is a component breakdown diagram of Embodiment 3 of the filling container according to the present invention.
Figure 12:
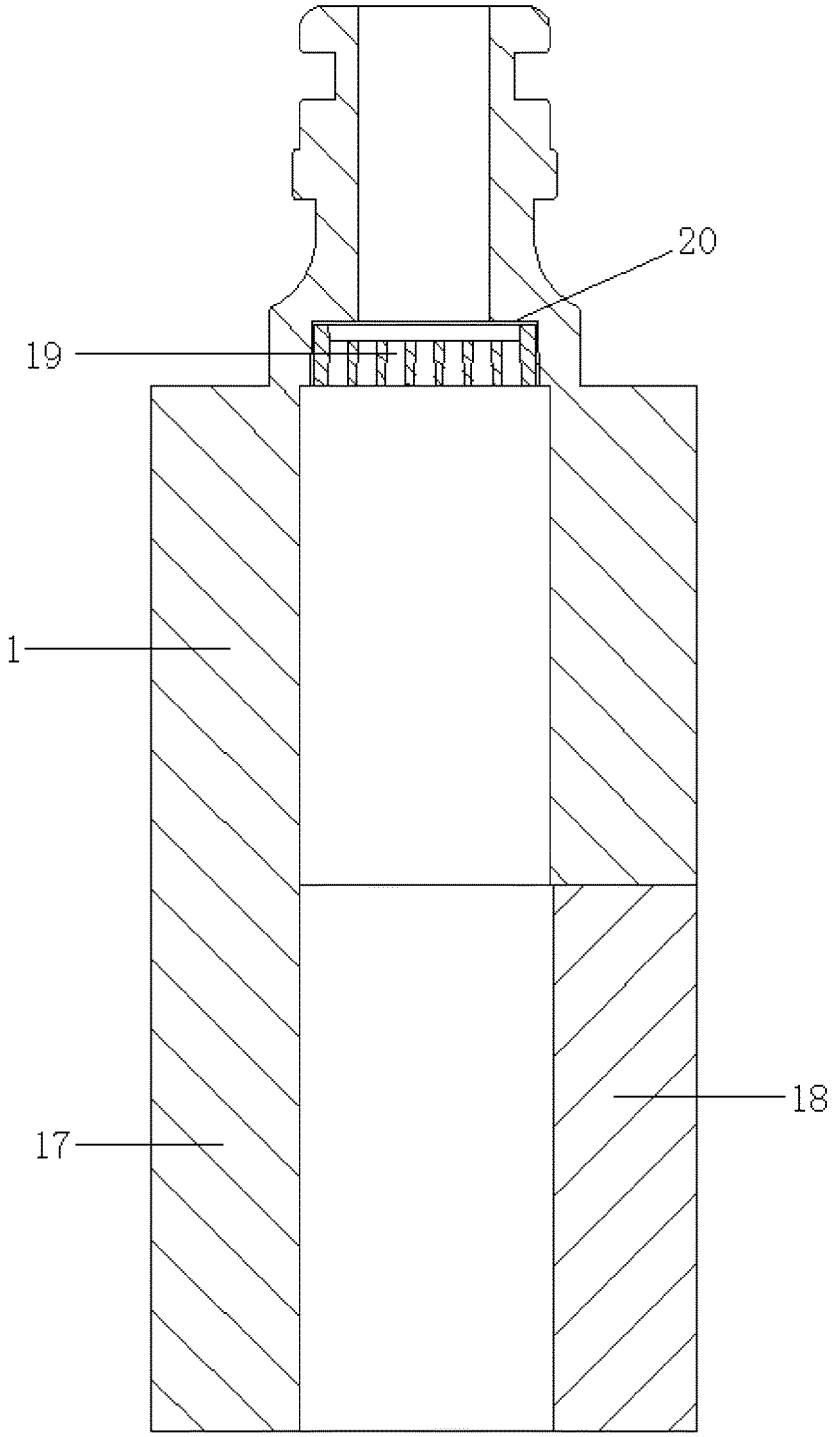
FIG. 12 is a schematic diagram of cooperation among a joint, a clamping groove, a filtering block, and a compression block of Embodiment 3 according to the present invention.
Figure 13:
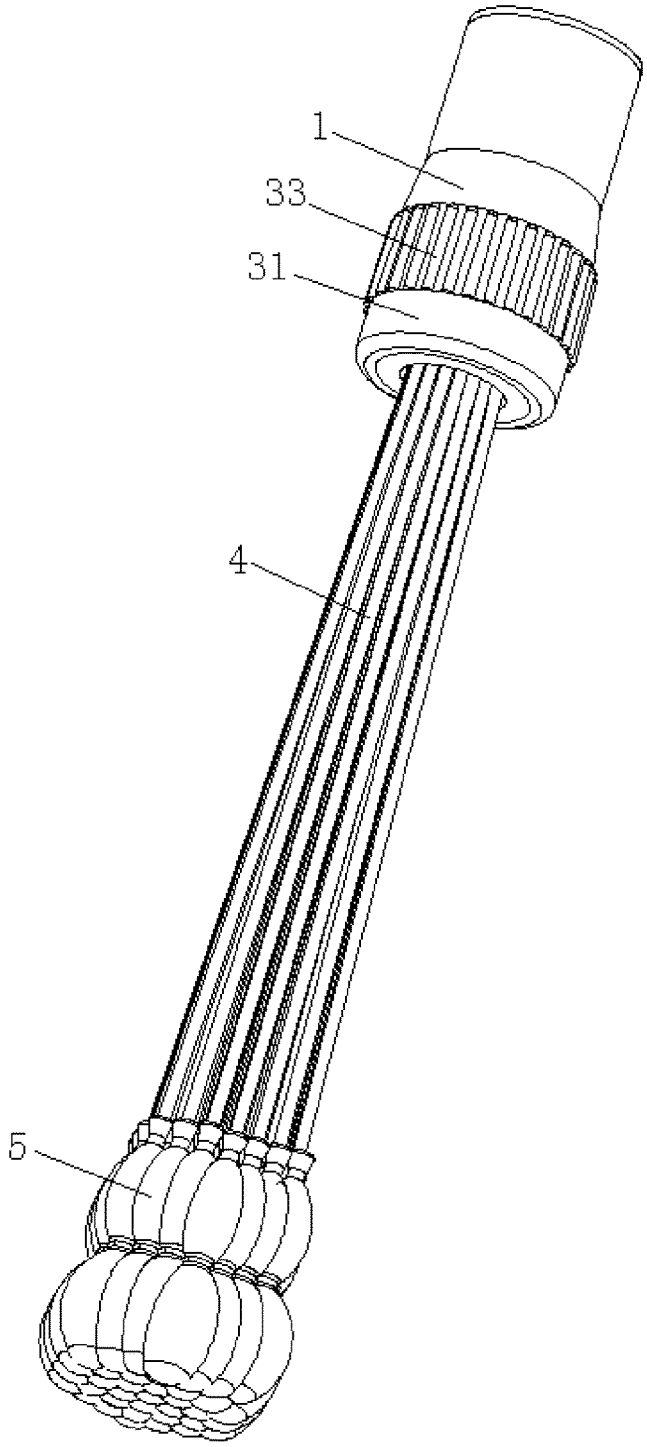
FIG. 13 is a first schematic structural diagram of Embodiment 4 of a filling container according to the present invention.
Figure 14:
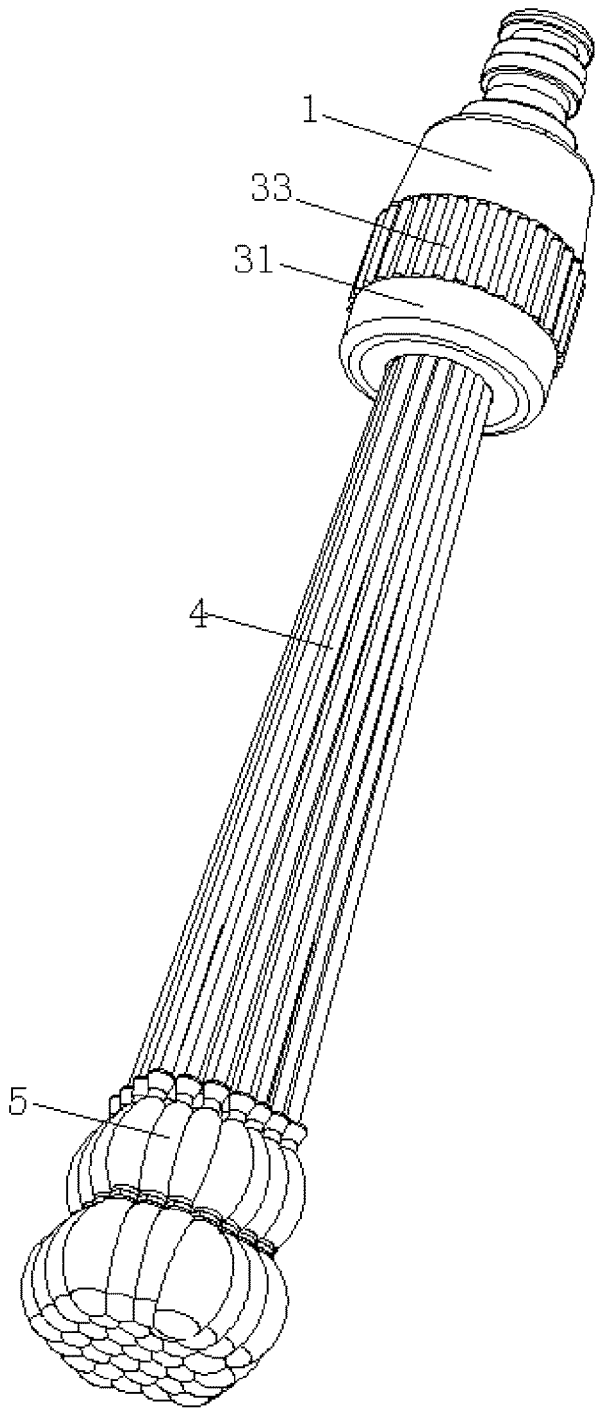
FIG. 14 is a second schematic structural diagram of Embodiment 4 of the filling container according to the present invention.
Figure 15:
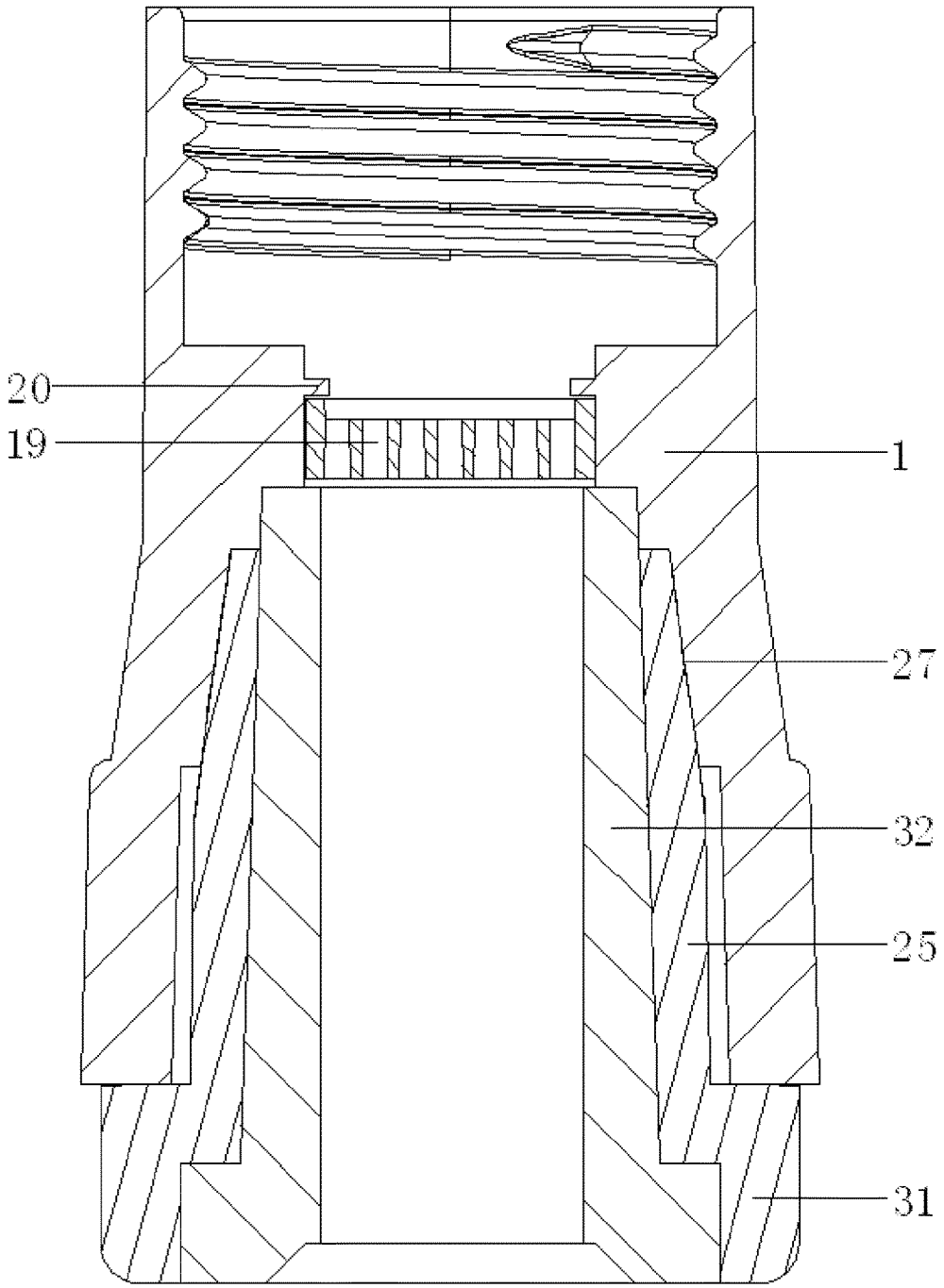
FIG. 15 is a first schematic diagram of a joint, a clamping sleeve, and a seal soft cushion of Embodiment 4 according to the present invention.
Figure 16:
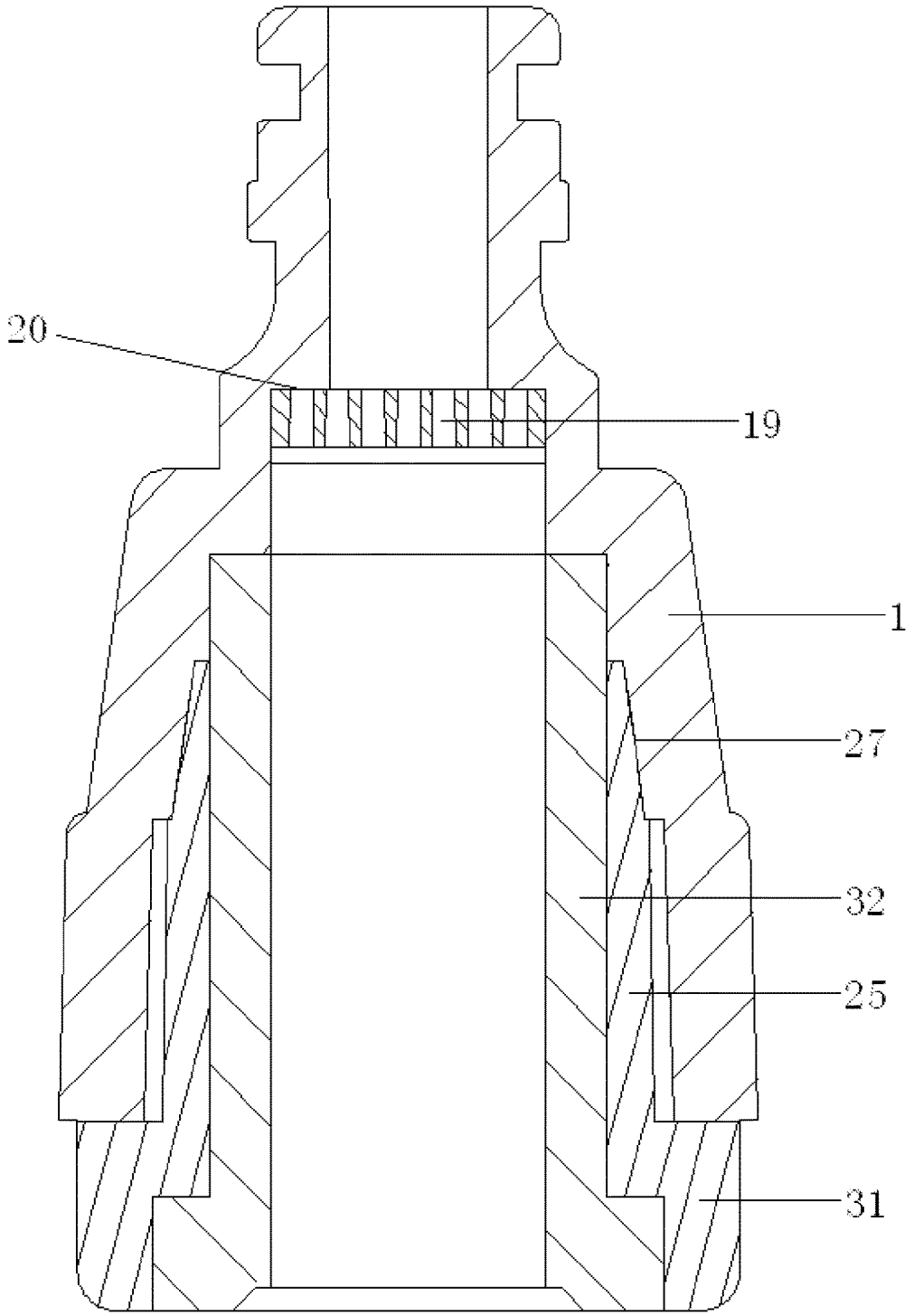
FIG. 16 is a second schematic diagram of a joint, a clamping sleeve, and a seal soft cushion of Embodiment 4 according to the present invention.
Figure 17:
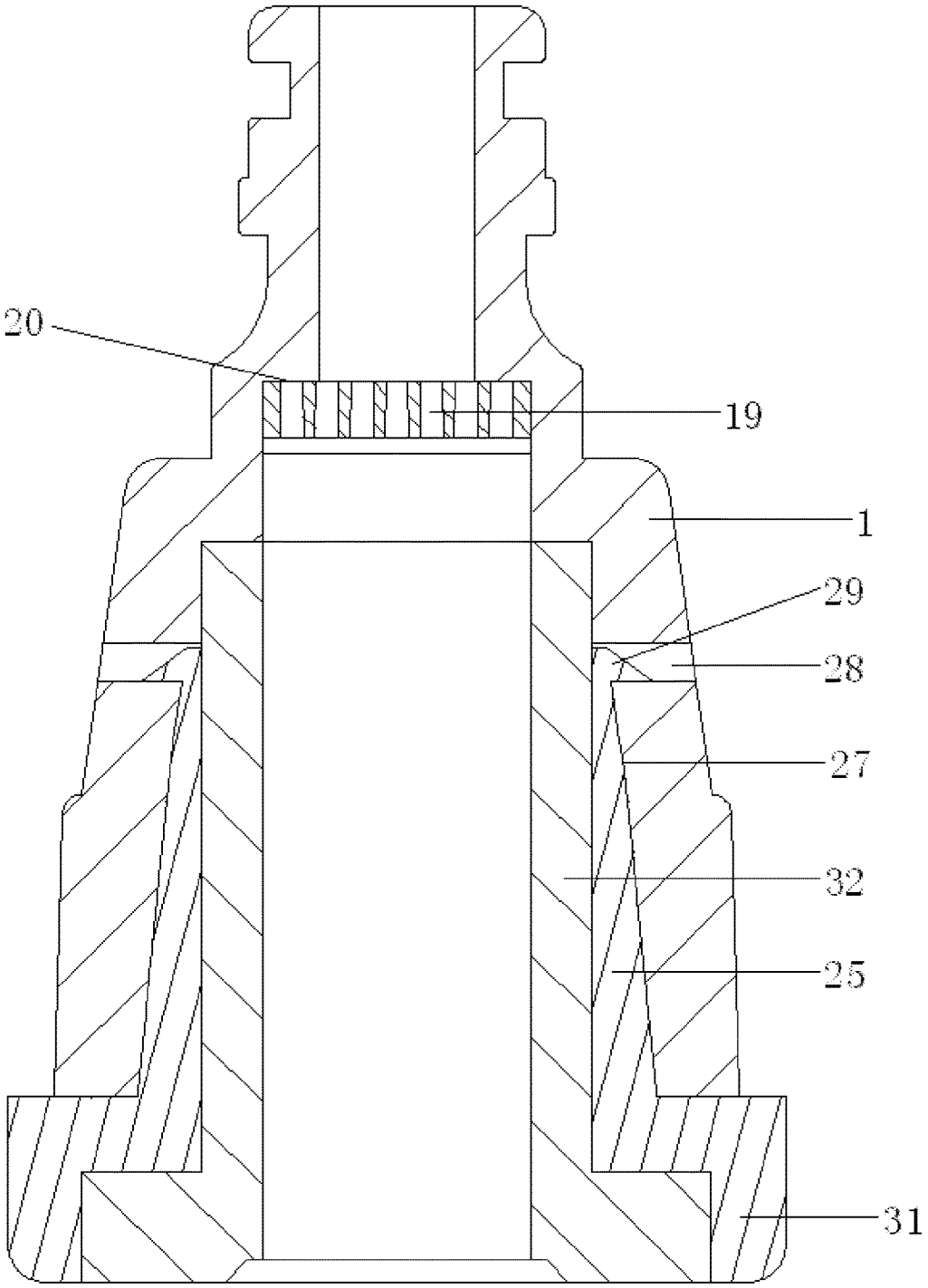
FIG. 17 is a schematic diagram of cooperation among a joint, a clamping sleeve, and a seal soft cushion of Embodiment 5 according to the present invention.
Figure 18:
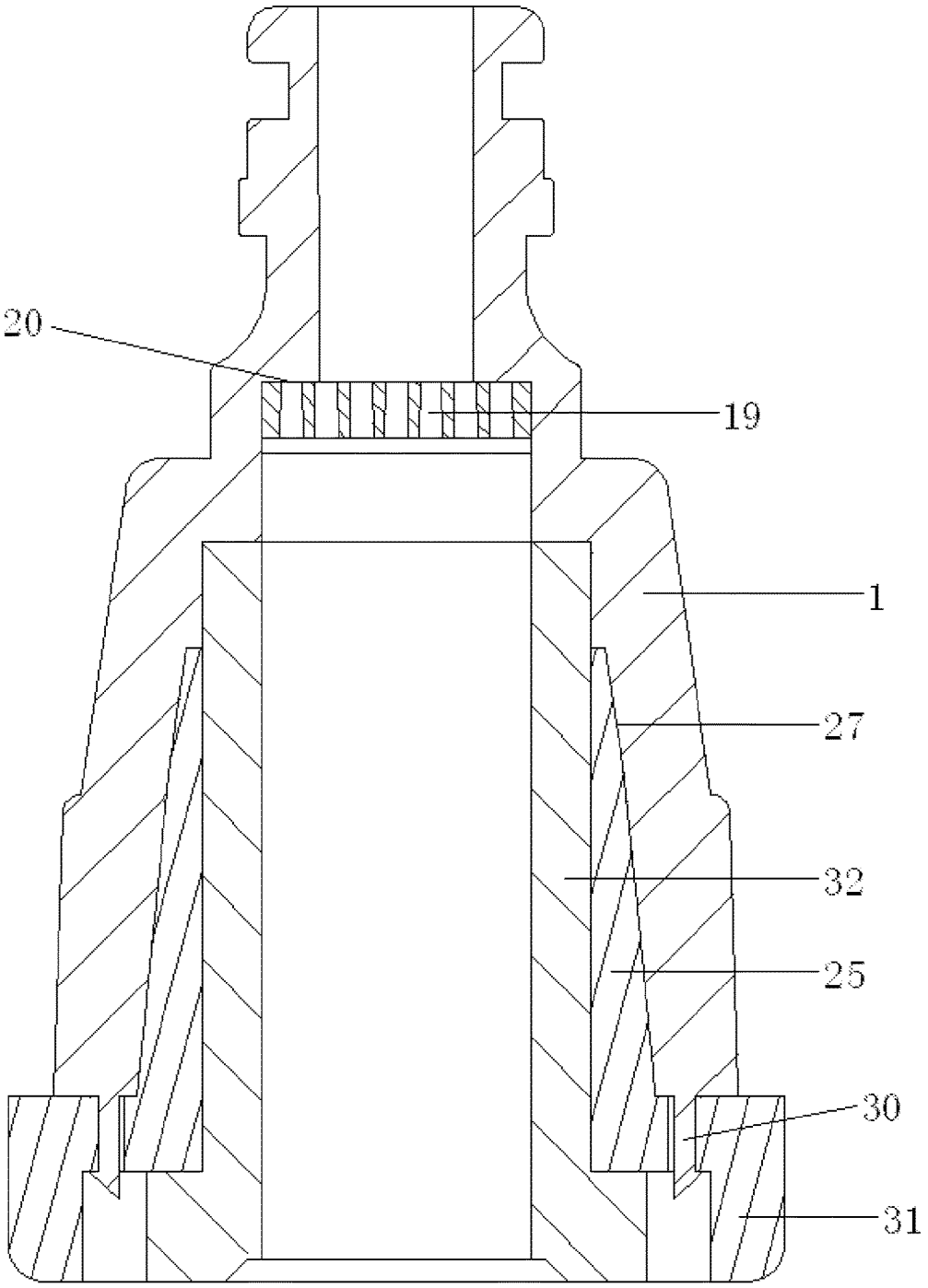
FIG. 18 is a schematic diagram of cooperation among a joint, a clamping sleeve, and a seal soft cushion of Embodiment 6 according to the present invention.
Figure 19:
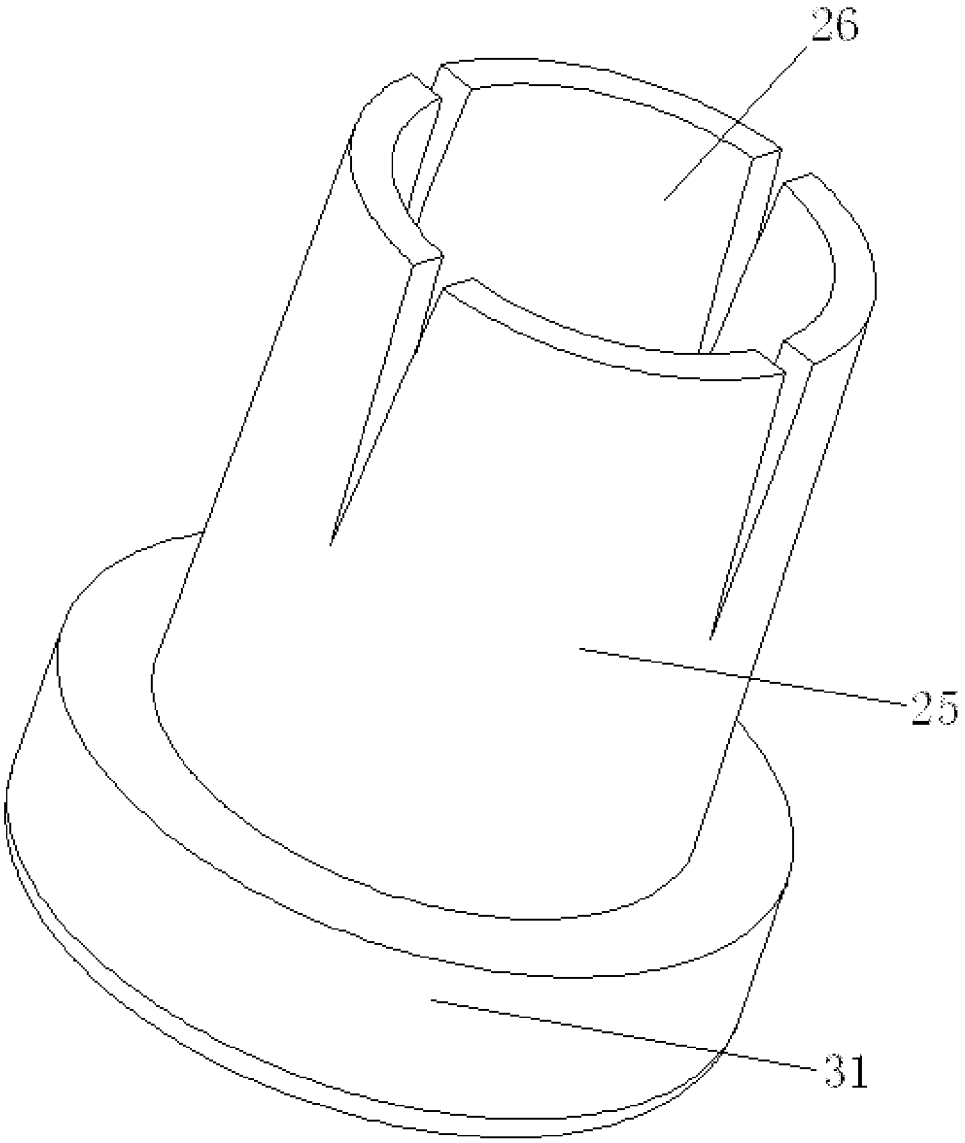
FIG. 19 is a schematic structural diagram of a clamping sleeve according to the present invention.

The reference numerals and their corresponding elements in the drawings: 1—joint; 2—rubber sleeve; 3—convex ring; 4—hollow tube bundle; 5—balloon; 6—concave ring; 7—hose clamp; 8—banding strap; 9—banding shell; 10—locking worm; 11—handle; 12—first end; 13—second end; 14—toothed hole; 16—orthohexagnal hollow tube; 17—clamping groove; 18—compression block; 19—filtering block; 20—step; 21—fixed block; 22—slide groove; 23—second seal soft cushion; 24—first seal soft cushion; 25—clamping sleeve; 26—holding plate; 27—slope; 28—clamping hole a; 29—clamping block a; 30—clamping block b; 31—flange; 32—third seal soft cushion; and 33—skidproof stripe.

DETAILED DESCRIPTION

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used herein, the terms "comprise" or "comprising," "include" or "including," "carry" or "carrying," "has/have" or "having," "contain" or "containing," "involve" or "involving" and the like are to be understood to be open-ended, i.e., to mean including but not limited to.

As used herein, the phrase "at least one of A, B, and C" should be construed to mean a logical (A or B or C), using a non-exclusive logical OR. It should be understood that one or more steps within a method may be executed in different order (or concurrently) without altering the principles of the invention.

The description is now made as to the embodiments of the present invention in conjunction with the accompanying drawings. In accordance with the purposes of the present invention, as embodied and broadly described herein, the present invention relates to a filling container.

Embodiment 1

A filling container includes a joint 1, a hollow tube bundle 4, a container, and a banding apparatus.

A side of the joint 1 is provided with an inlet, another side of the joint is provided with a tube insertion cavity, and an inner end of the tube insertion cavity is connected to the inlet.

The hollow tube bundle 4 includes several hollow tubes. An upper part of the hollow tube bundle is entirely inserted into the tube insertion cavity. A lower part of the joint 1 is connected to a rubber sleeve 2. A lower-end open mouth of the rubber sleeve 2 forms the tube insertion cavity. The upper part of the hollow tube bundle 4 is inserted into the rubber sleeve. The holding mechanism includes the banding apparatus surrounding a peripheral portion of the rubber sleeve. The banding apparatus contracts, bands the rubber sleeve, and enables the rubber sleeve to hold the hollow tube bundle. Preferably, a water outlet end of the joint 1 extends downward out of a convex ring 3, and an upper end of the rubber sleeve 2 is disposed outside the convex ring 3 in a sleeved manner and is combined with the convex ring 3.

The container is mounted at a lower end portion of a hollow tube by using an elastic fastener, and an inner cavity of the container is in communication with a passage of the hollow tube. Specifically, the container may be a balloon 5 or a container used for collecting a liquid or gas such as a blood collecting bottle or a urine collecting bottle. If the container is the balloon 5, when the weight of water in the balloon reaches a specific extent, the balloon is basically filled up with water, the balloon that is filled up with water automatically detaches because the gravity is greater than a clamping force, and the elastic fastener automatically seals the balloon that is filled up with water, or when the balloon is basically filled up with water, the balloon is manually removed; and if the container is a blood collecting bottle or a urine collecting bottle, blood or urine is extracted from a human (or an animal) by connecting a proper conduit to the joint, and the joint may be an outer joint, an inner joint, a tubular joint, a spiral joint, or the like as long as the joint can keep pressure for water feeding.

The banding apparatus surrounds an outer side wall of the rubber sleeve 2, so that the banding apparatus contracts, bands the rubber sleeve, and enables the rubber sleeve to hold the hollow tube bundle 4.

The hollow tube bundle 4 is formed by combining several hollow tubes having an orthohexagnal cross section, so as to form a hollow tube bundle 4 having a honeycomb-shaped cross section; or the hollow tube bundle 4 is formed by combining several hollow tubes having a circular cross section.

The outer side wall of the rubber sleeve 2 sinks to form a concave ring 6, the banding apparatus is disposed inside the concave ring 6 to prevent the banding apparatus from detaching; or a lower-end circumferential edge of the rubber sleeve radially extends outward out of a blocking ring, and the blocking ring abuts against the banding apparatus and prevents the banding apparatus from detaching.

The banding apparatus is a ribbon, a rope, a rubber band, or a hose clamp 7.

The hose clamp 7 includes a banding strap 8, a banding shell 9, and a locking worm 10; the banding shell 9 is hollow, and the interior thereof is a through hole; the locking worm 10 is disposed inside the through hole of the banding shell 9; the banding shell 9 is fixed to a first end 12 of the banding strap 8, a second end 13 of the banding strap passes through the through hole of the banding shell 9, and a toothed hole 14 on the second end of the banding strap 8 matches a screw thread of the locking worm 10, the locking worm 10 screws the banding strap which contracts, bands the rubber sleeve, and enables the rubber sleeve to hold the hollow tube bundle 4; and specifically, an tail end of the locking worm extends backward out of a handle 11, and the design of the handle 11 makes it more convenient to apply a force and easier to perform an operation.

The joint is a nipple joint.

The elastic fastener is a rubber band, an elastic rubber ring, or a clip.

The hollow tube is a flexible hollow tube.

Embodiment 2

Embodiment 2 is partially the same as Embodiment 1, and the differences are as follows:

A side of the joint extends outward to form a clamping groove 17; and the holding mechanism is a compression block 18, the compression block 18 is detachably mounted inside the clamping groove 17, and the clamping groove 17 cooperates with the compression block 18 to enclose the tube insertion cavity; and a compression surface of the compression block is an arc-shaped surface; the compression surface cooperates with a side surface of an inner wall of the clamping groove to form a circular bayonet, in this way, a hollow tube component is a hollow tube bundle matching a shape of the bayonet, a second seal soft cushion 23 is disposed between the several hollow tubes and aside wall of the bayonet, a part of the second seal soft cushion 23 is fixed to the compression surface of the compression block, another part thereof is fixed to the inner wall of the clamping groove 17, and the two parts of the second seal soft cushion 23 form an annular soft cushion.

A fixed block 21 is formed on two sides of the compression block, a slide groove 22 matching the fixed block 21 is formed on a side wall of the clamping groove, and the fixed block is fixedly connected to the slide groove 22 by using a fastener. Specifically, the fastener is a screw, a screw nut, or the like.

A filtering block 19 is disposed inside a passage that connects the inlet and the tube insertion cavity inside the joint, several through holes running from top to bottom are formed on the filtering block 19, the filtering block is disposed above the hollow tube, and the shape of the filtering block 19 matches the shape of a fluid passage; the filtering block 19 is connected to a side wall of a housing in a screwed manner, a gluing manner, or a clamping manner; a step 20 is formed on an inner wall of the passage that connects the inlet and the tube insertion cavity inside the joint, an upper end of the filtering block abuts against the step 20, and a lower end of the filtering block abuts against an upper end of the hollow tube bundle to be fixed.

The filtering block 19 is connected to the housing in a screwed manner, a gluing manner, or a clamping manner, and preferably, a screwed connection is adopted in the present invention.

Embodiment 3

Embodiment 3 is substantially the same as Embodiment 2, and the differences are:

A compression surface of the compression block 18 is a plane; and the compression surface cooperates with an inner side wall of the clamping groove 17 to form a square bayonet.

Figure 20:
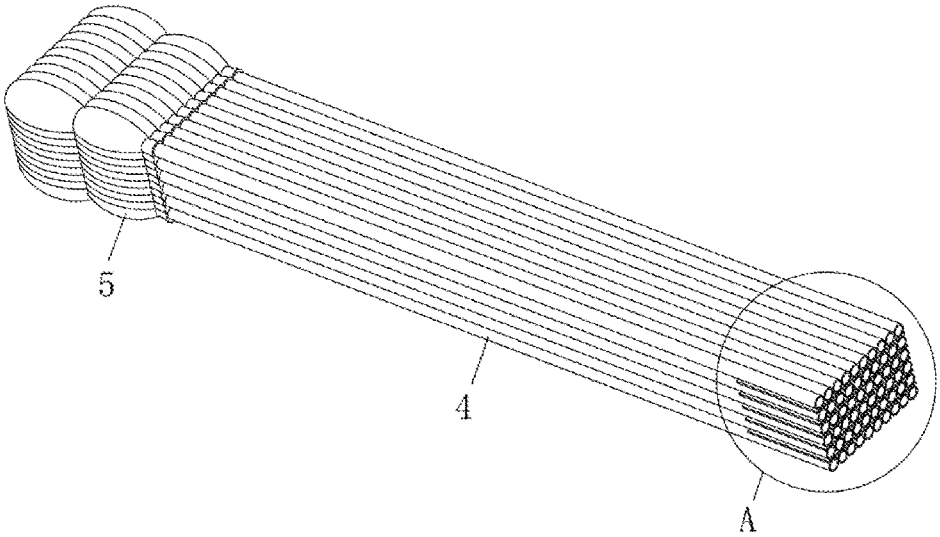
FIG. 20 is a schematic structural diagram of a first seal soft cushion disposed between two adjacent hollow tube layers according to the present invention.
Figure 21:
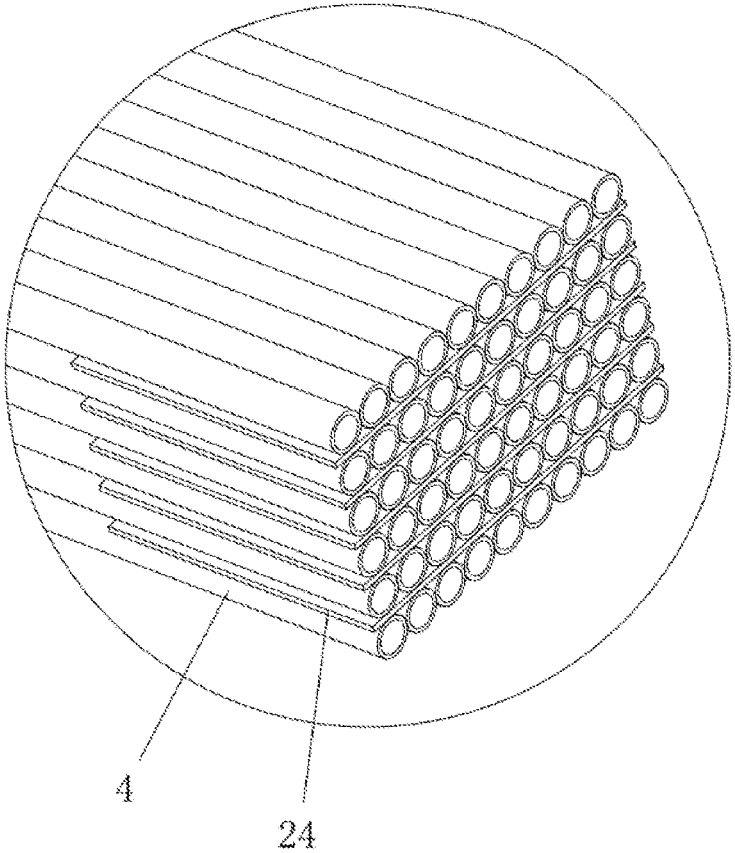
FIG. 21 is an enlarged view of portion A in FIG. 20.

The hollow tube bundle 4 includes several hollow tube layers 4, and a first seal soft cushion 24 is disposed between two adjacent hollow tube layers 4, as shown in FIGS. 20 and 21. The hollow tube layer is formed by arranging several hollow tubes, and a cross-sectional shape of the hollow tube is circular or orthohexagnal.

Embodiment 4

Embodiment 4 is substantially the same as Embodiment 2, and the differences are:

A clamping sleeve 25 is mounted on a side of the joint, several holding plates 26 are formed on the clamping sleeve 25, and the several holding plates 26 enclose the tube insertion cavity; and an inner wall of the joint 1 protrudes inward to form a slope 27, and when the clamping sleeve 25 extends into the joint 1 and is fastened, a slope surface of the slope 27 abuts against the holding plates 26, and the holding plates 26 incline inward and hold the hollow tube bundle 4.

The joint 1 is spirally connected to the clamping sleeve 25; and an outer wall of the holding plate 26 or an upper end of the clamping sleeve is provided with an outer screw thread, and the slope surface of the slope 27 or a lower end of the joint is provided with a matching inner screw thread. When the housing 17 is screwed up to the clamping sleeve 25, the holding plates 26 on the upper part of the clamping sleeve 25 contracts inward, so as to clamp the hollow tube bundle 4.

A third seal soft cushion 32 is disposed between several hollow tubes and the side wall of the clamping sleeve, the seal soft cushion may be directly combined with an inner surface of the clamping sleeve, and the third seal soft cushion 32 may be a ring or an annular sleeve.

A skidproof strip 33 is formed on an outer wall of the housing.

Embodiment 5

Embodiment 5 is substantially the same as Embodiment 4, and the differences are:

The clamping sleeve 25 is connected to the housing 17 in a clamping manner; and a clamping hole a28 is formed on the slope 27 of an inner wall of the housing, and a clamping block a29 matching the clamping hole a28 is formed on an outer surface of a holding plate 26 of the clamping sleeve; and when the housing is disposed inside the clamping sleeve in a sleeved manner, the holding plates 26 on the upper part of the clamping sleeve contract inward, so as to clamp the hollow tube bundle, and the clamping block a29 jams the clamping hole a28 to prevent the clamping sleeve 25 from detaching.

Embodiment 6

Embodiment 6 is substantially the same as Embodiment 5, and the differences are:

The clamping sleeve 25 is connected to the housing 17 in a clamping manner; and a lower end surface of the housing extends downward to form several clamping blocks b30, a lower end of the clamping sleeve radially extends to form a flange 31, and several clamping holes b matching the clamping blocks b30 are formed on the flange 31; and when the housing is disposed inside the clamping sleeve in a sleeved manner, the holding plates on the upper part of the clamping sleeve contract inward, so as to clamp the hollow tube bundle, and the clamping block b jams the clamping hole b to prevent the clamping sleeve from detaching.

The present invention has the following features: the structure is simple, the use is convenient, multiple water balloons or balloons can be simultaneously produced or balloons are simultaneously filled with another liquid, the efficiency of producing water balloons or balloons or filling the balloons with another liquid is high, the tightness is high, and the use can be repeated.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A filling container, comprising:

a joint, wherein a side of the joint is provided with an inlet, another side of the joint is provided with a tube insertion cavity, and an inner end of the tube insertion cavity is connected to the inlet;

a hollow tube bundle, comprising several hollow tubes, wherein an upper part of the hollow tube bundle is entirely inserted into the tube insertion cavity;

a container, mounted at a lower end portion of a hollow tube by using an elastic fastener, wherein an inner cavity of the container is in communication with an inner passage of the hollow tube; and a holding mechanism, mounted on the joint at the tube insertion cavity, wherein the holding mechanism enables the tube insertion cavity to contract and hold the hollow tube bundle, wherein the side of the joint extends outward to form a clamping groove; and the holding mechanism is a compression block, the compression block is detachably mounted inside the clamping groove, and the clamping groove cooperates with the compression block to enclose the tube insertion cavity.

2. The filling container according to claim 1, wherein a lower part of the joint is connected to a rubber sleeve, a lower-end open mouth of the rubber sleeve forms the tube insertion cavity, and the upper part of the hollow tube bundle is inserted into the rubber sleeve; and the holding mechanism comprises a banding apparatus surrounding a peripheral portion of the rubber sleeve, and the banding apparatus contracts and bands the rubber sleeve and enables the rubber sleeve to hold the hollow tube bundle.

3. The filling container according to claim 1, wherein a fixed block is formed on two sides of the compression block, a slide groove matching the fixed block is formed on a side wall of the clamping groove, and the fixed block is fixedly connected to the slide groove by using a fastener.

4. The filling container according to claim 3, wherein a compression surface of the compression block is a plane; and the compression surface cooperates with an inner side wall of the clamping groove to form a square bayonet.

5. The filling container according to claim 4, wherein the hollow tube bundle comprises several hollow tube layers, and a first seal soft cushion is disposed between two adjacent hollow tube layers.

6. The filling container according to claim 3, wherein a second first seal soft cushions disposed between the hollow tube bundle and a side wall of a bayonet.

7. The filling container according to claim 1, wherein the hollow tube bundle is formed by combining several hollow tubes having an orthohexagnal cross section, so as to form a hollow tube bundle having a honeycomb-shaped cross section; or the hollow tube bundle is formed by combining several hollow tubes having a circular cross section.

8. The filling container according to claim 1, wherein a filtering block is disposed inside a passage that connects the inlet and the tube insertion cavity inside the joint, several through holes running from top to bottom are formed on the filtering block, and the filtering block is disposed above the clamping sleeve.

9. The filling container according to claim 8, wherein a step is formed on an inner wall of the passage that connects the inlet and the tube insertion cavity inside the joint, an upper end of the filtering block abuts against the step, and a lower end of the filtering block abuts against an upper end of the hollow tube bundle.

* * * * *